United States Patent [19]

Vrenning

[11] Patent Number: 4,941,515

[45] Date of Patent: Jul. 17, 1990

[54] LASHING MACHINE

[76] Inventor: Jörgen Vrenning, Ejdervägen, Huddinge, Sweden

[21] Appl. No.: 319,765

[22] PCT Filed: Aug. 21, 1987

[86] PCT No.: PCT/SE87/00368

§ 371 Date: Feb. 17, 1988

§ 102(e) Date: Feb. 17, 1988

[87] PCT Pub. No.: WO88/01671

PCT Pub. Date: Mar. 10, 1988

[30] Foreign Application Priority Data

Aug. 27, 1986 [SE] Sweden ..... 8603613

[51] Int. Cl.[5] ..... B21F 15/04

[52] U.S. Cl. ..... 140/119; 140/57

[58] Field of Search ..... 140/53, 54, 56, 57, 140/93 A, 119

[56] References Cited

U.S. PATENT DOCUMENTS 3,026,915 3/1962 Jones et al. ..... 140/119

3,169,559 2/1965 Working, Jr. ..... 140/119

*Primary Examiner*—Lowell A. Larson

*Attorney, Agent, or Firm*—Sughrue, Mion, Zinn, Macpeak & Seas

[57] ABSTRACT

A lashing machine for lashing together mutually intersecting elongated members with the aid of U-shaped wire ties, particularly for lashing together concrete reinforcement rods, comprises a magazine (9) for wire ties (10); means (12) for dispensing ties singly from the magazine in a manner such that respective ties can be caused to engage over two mutually crossing elongated members at their mutual point of intersection; and a twisting or lashing head (18) for receiving, holding and twisting together the limbs of respective ties (10). In accordance with the invention, the lashing head (18) comprises two mutually opposing, pivotable jaws (23) which define therebetween a slot-like opening for receiving the limbs of respective ties (10). The jaws can be relative to one another in a manner to reduce the width of the slot-like opening so as to grip the limbs of the tie therebetween. Means are provided for rotating the jaws about a common axis in the closed clamping position of the jaws, in a manner to twist together the limbs of the tie held in the jaws.

12 Claims, 3 Drawing Sheets

10
19

9
7
21
20
22
18
15
4
1

16
14
17
2
5
5
13
3
7
8
12
6
9
6
10
11
20
19
19
18

10
19
23
23

LASHING MACHINE

The present invention relates to a lashing machine for lashing together mutually crossing elongated members with the aid of U-shaped wire ties, and particularly, although not exclusively, for lashing together concrete reinforcement rods, said machine including a tie magazine, means for dispensing the ties singly from the magazine in a manner such that each tie is caused to engage over two mutually intersecting elongated members at their point of intersection, and a lashing head for receiving, holding and twisting together the limbs of respective U-shaped ties.

Reinforcement rods, bars, etc., are traditionally lashed together to form tied mesh reinforcements, with the aid of simple, manually manipulated tools. This method is extremely time consuming, and therewith expensive. The work involved is also laborious and is highly likely to result in, inter alia, wear damage. This is due to the fact that when lashing together concrete reinforcement rods, tied mesh reinforcements for concrete slabs, concrete floor structures, vault structures, and like structures, with the aid of present day tools, the workman concerned is required to stoop for considerable lengths of time, resulting in considerable strain on the spine.

When lashing reinforcement rods, the wire ties are normally placed manually around the rods at the various cross-over points thereof and the ends of the ties twisted or twined together with the aid of pliers or like tools, so that the reinforcement rods are firmly held together. Conventional lashing methods of this kind are also extremely hazardous, particularly when working on roof structures, bridges and the like, due to the fact that the workman concerned must adopt a stooping position, which inter alia increases the risk of accidents. Furthermore, when practising conventional lashing methods, the ends of the wire ties are twisted together on the upper side of the tied mesh reinforcement, therewith forming sharp, upstanding points which are also liable to result in injury to those workmen concerned with the construction work.

The present invention is based on the realization that the work of lashing together reinforcement rods could be made more effective and the aforesaid injury hazards eliminated, or greatly reduced, if access could be had to an automatically operating lashing or tying machine so constructed as to enable the workman to stand upright during a lashing operation and such as to enable the ends of the wire ties to be twisted together on the underside of the reinforcement rods or tied mesh reinforcement.

An automatic lashing or tying machine is known to the art from DE-A-1 1 434 519. This known machine, however, is a hand-operated machine which requires the workman to adopt a stooping position when working on vault structures and the like. The known machine also exhibits other serious disadvantages. For example, the magazine holding the U-shaped wire ties is located at a constant distance above a lashing head, which, inter alia, prevents the reinforcement rods from being pressed against one another in conjunction with a lashing operation. A further disadvantage with the known machine is that the wire ties must be displaced from the magazine to a relatively large extent before reaching their final position of engagement with the reinforcement rods to be lashed.

In addition, the lashing head of the known machine is relatively complicated, since it includes two axially and relatively moveable parts between which the ends of the wire ties are held. The outer part of these axially displaceable parts is intended to be drawn upwardly by respective lashing ties during a lashing operation, while the inner part of the head is pressed downwardly at the end of the lashing operation. When lashing of the reinforcement rods is completed and the ends of the wire ties have been released from the head, the outer part of the lashing head is intended to move downwards at the same time as the inner part moves upwards. Due to the small tolerances and clearances permitted, the mechanism is highly susceptible to damage and to malfunction as a result of the ingress of dirt and dust, and is hardly suited for use on building sites.

Another disadvantage with the known lashing head is that it is constructed for a wire tie of specific dimensions, both with regard to the thickness or gauge of the wire and with the distance between the two limbs of the tie, since the ends of respective ties are to be pressed down between the inner and outer parts of the head. This represents a difficultly achieved working operation, which requires the ends of the wire ties to be pointed and which can readily lead to malfunctioning of the head should the wire tie become bent as it is pressed down between said inner and outer head parts. With the known lashing head, the ends of the wire ties are held solely by rotation of the outer head element, and not as a result of positive clamping of the ends of the ties, which also represents an unreliable working condition.

The main object of the present invention is to provide a lashing or tying machine in which, inter alia, the aforementioned disadvantages associated with the known machine are eliminated. Thus, the inventive machine shall enable concrete reinforcement rods to be lashed together from an upright position, with the aid of a simple and robust lashing head capable of firmly holding the limbs of a wire tie during a lashing operation and enabling lashing to be effected with ties of highly varying dimensions with regard to wire thickness or gauge and limb spacing. The lashing head shall also be reliable in operation and, inter alia, greatly eliminate the risk of undesirable bending of the wire ties prior to applying the ties around the mutually intersecting concrete reinforcement rods of a tied mesh reinforcement.

A lashing machine of the aforementioned kind constructed in accordance with the invention is characterized mainly in that the lashing head comprises two mutually opposing jaws which define therebetween a slot-like opening intended for receiving the limbs of respective wire ties; in that the jaws are arranged to be swung relative to one another in a manner to reduce the width of the slot-like opening so as to firmly clamp the limbs of respective ties located therebetween; and in that, in their closed clamping position, the jaws are intended to be rotated together about a common axis in a manner to twist the limbs of the tie together.

In accordance with one embodiment of the inventive lashing machine the jaws are pivotally mounted at opposite ends, such that the defining edges of the slot-like opening are maintained in a substantially mutually parallel relationship when the jaws are swung synchronously towards one another. To this end, the inventive machine preferably includes a rotatable element which surrounds the jaws and which presents two members which co-act with said jaws for pivoting the jaws relative to one another and for dogging the jaws in the direction of rotation of the rotating element upon completion of said pivotal movement.

In accordance with one preferred embodiment the jaws are pivotally mounted on a common, rotatable holder which is intended to be rotated by the jaws upon completion of their pivotal movement. According to another preferred embodiment, the holder is dogged into rotation by the jaws subsequent to overcoming the force of a latching spring.

For the purpose of releasing the ends of a wire tie subsequent to completing a lashing operation, the jaws are preferably constructed so as to be released and to execute a return pivot movement when reversing the direction of rotation of the rotating element.

In order to guide the limbs of a wire tie into the slot-like opening defined by the jaws, the jaws are preferably provided with semi-circular, cup-shaped recesses which guide the limbs of respective ties towards the opening irrespective of the original position of orientation of the ties.

For the purpose of enabling, for instance, two mutually crossing reinforcement rods to be pressed against one another during a lashing operation, the magazine is preferably mounted on a holder device or dispenser which is capable of moving towards and away from the lashing head and which cooperates with a tie dispensing member capable of moving relative to the dispenser. In this regard, the dispenser preferably includes a press head or plate having formed thereon mutually perpendicular guide grooves, for guiding and pressing the rods against the twisting head as a wire tie is dispensed. The dispensing member may have the form of a plate which is guided by the dispenser for co-action with the leading or foremost tie in the tie magazine.

The invention will now be described in more detail with reference to an exemplifying embodiment of a lashing machine constructed in accordance with the invention and illustrated in the accompanying drawings.

Figures 1, 2, 3, 4:
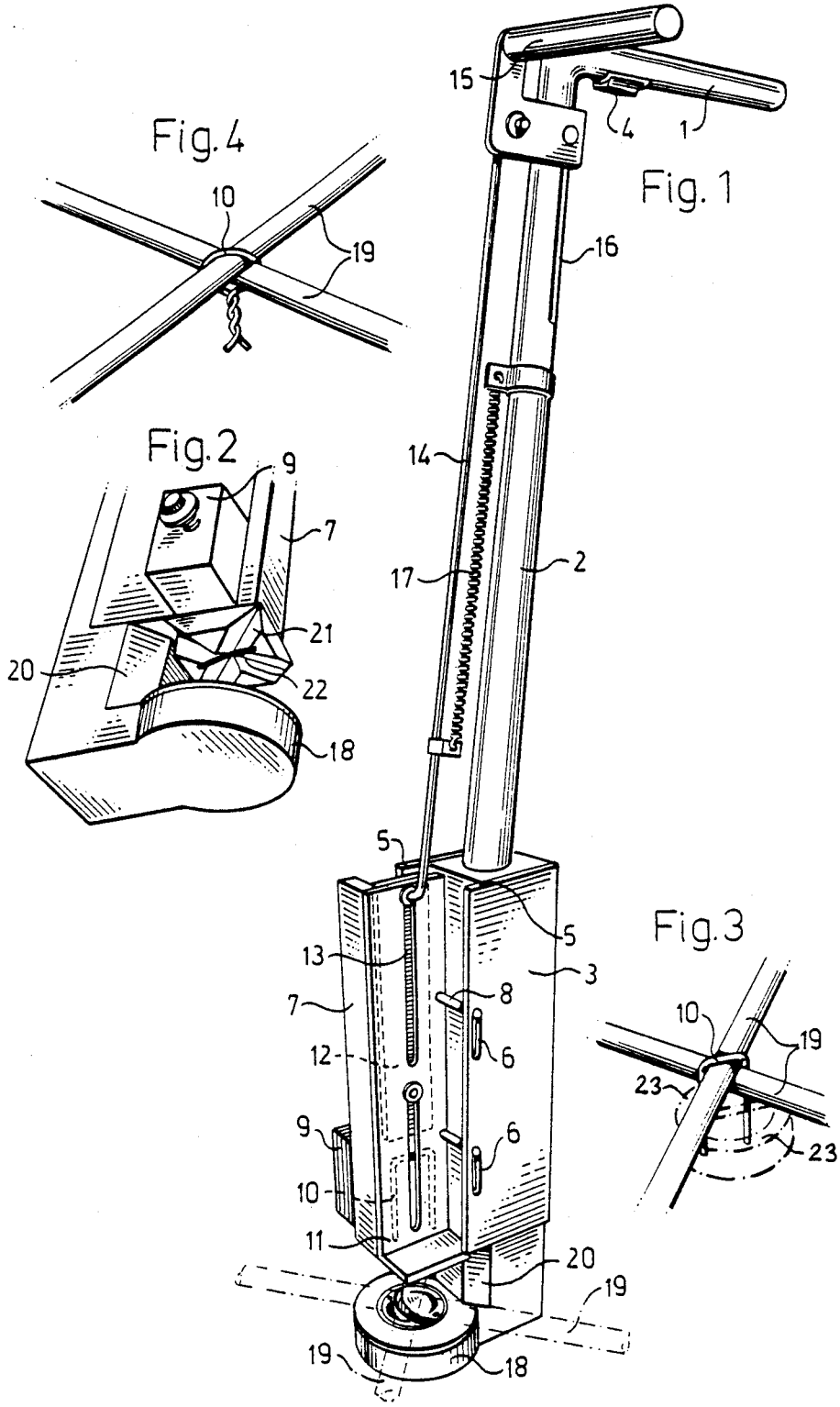
FIG. 1, is a perspective view of an automatic lashing machine constructed in accordance with the invention.
FIG. 2 is a perspective view of part of the machine illustrated in FIG. 1, taken from beneath.
FIG. 3 illustrates a working principle in a lashing operation.
FIG. 4 illustrates two mutually crossing reinforcement rods that have been lashed together.

The automatic lashing machine of the FIG. 1 embodiment comprises an elongated shaft 2 which carries an operating handle 1 at its one end and a tying or lashing assembly at the other end. The illustrated lashing assembly includes an elongated box-like housing 3 which encloses a battery-operated electric motor, neither the battery nor the motor being shown in the Figure. The battery used may be a rechargeable battery. The motor is operated through a switch 4 provided on the operating handle 1, and electric cables that pass axially along and within the shaft 2.

Mounted for axial relative movement along one side of the housing 3 is an elongated tie dispenser 7. The dispenser 7 is guided for movement relative to the housing 3 through the agency of pins 8 which protrude outwardly from a defining wall of the dispenser 7 and which engage in respective slots 6 formed in flanges 5 projecting from the housing 3. The dispenser 7 carries at its end remote from the handle 1 a magazine 9 for wire ties 10, which in this embodiment are pre-bent to a U-shaped configuration. The ties are preferably arranged in the magazine 10 in rows, in a manner similar to that of conventional wire staples used in office stapling machines, and are urged by a spring (not shown) towards and against a defining wall 11 of the dispenser 7, with the open ends of the ties facing away from the handle 1.

As illustrated in FIG. 1, the wall 11 has provided therein slots 13 which extend axially along the wall. The upper slot 13 is intended to receive one end of a push-and-pull rod 14, the other end of which is attached to a bracket mounted on a further handle 15 located adjacent the operating handle 1. The attachment bracket holding the further handle 15 is slideably mounted in a slot 16 extending axially along the upper part of the shaft 2, beneath the operating handle 1, such as to enable the handle 15 and the rod 14 to be moved axially backwards and forwards relative to the shaft 2, wherewith forward or, as shown, downward movement of the handle 15 and the rod 14, is effected against the action of a return spring 17 which extends between the shaft 2 and the rod 14 in the manner illustrated in FIG. 1.

The aforementioned one end of the rod 14 engages through the upper slot 13, a slide dispenser plate 12 which is arranged slideably within the dispenser 7 and guided by the lower slot 13 adjacent to and parallel with the defining wall 11 thereof, wherewith relative movement of the dispenser plate 12 with the defining wall 11 of the dispenser 7 will cause the ejection of a tie 10 from the magazine 9.

The reference 18 designates a lashing head which is in axially spaced relationship with the bottom end of the dispenser and which is intended to be placed beneath two mutually crossing reinforcement rods 19 at their mutual point of intersection, when carrying out a lashing operation. In order to enable the lashing assembly and the ties 10 to be positioned correctly in relation to the reinforcement rods, the lashing assembly incorporates at a location adjacent the head 18, two guide surfaces 20 which preferably form right angles with one another and which are intended for guiding co-action with respective reinforcement rods, only one of said guide surfaces being shown in FIG. 1.

FIG. 2 is a perspective view which illustrates the lower part of the lashing machine from beneath and from the opposite side in relation to the FIG. 1 illustration, and which also shows the other of said two guide surfaces 20. As will also be seen from FIG. 2, the surface of the displaceable dispenser 7 facing the lashing head 18 has the form of a press head which incorporates two mutually perpendicular guide grooves 21 for receiving and guiding mutually crossing reinforcement rods 19. These grooves, together with the guide surfaces 20, ensure that the lashing machine is correctly positioned in relation to the reinforcement rods, irrespective of which rod lies upon the other, so that a slot-like opening 22 through which wire ties are dispensed is located precisely diagonally over the point of intersection of the rods.

When using the machine illustrated in FIGS. 1 and 2, the lashing head 18 is placed beneath the point of intersection of mutually crossing reinforcing irons 19, whereafter the displaceble dispenser 7 is forceably pressed, or allowed to fall under its own weight, against the reinforcing rods while moving the handle 15 downwardly. When the displaceable dispenser 7 is in abutment with the intersecting reinforcing rods 19, the handle 15 is moved downwards still further so as to cause relative movement between the dispenser plate 12 and the dispenser 7, such as to dispense a tie 10 through the opening 22 and diagonally over the cross formed by the mutually intersecting reinforcing rods, as illustrated in FIG. 3. As illustrated schematically in the Figure, the lower ends of the ties 10 will therewith project downwardly into a slot-like opening defined between two gripping jaws 23 arranged for relative movement in the lashing or twisting head 18. The jaws are caused to grip and hold the limbs of the ties in a manner hereinafter described, whereafter the jaws are rotated in a manner to twist the tie limbs together and therewith lash the reinforcement rods 19, as illustrated in FIG. 4. The limbs of respective ties are twisted together on the underside of respective rods, which is to great advantage.

Figure 5:
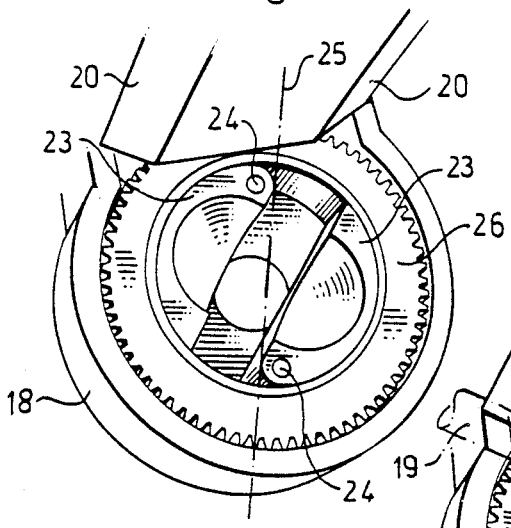
FIG. 5 illustrates the lashing head from above, with the cover plate removed.

FIG. 5 illustrates the lashing head 18 from above, with a cover plate that normally closes the head removed, and shows the jaws 23 in a starting position. The jaws 23 of the illustrated embodiment are pivotally mounted at mutually opposite ends thereof on pivot pins 24, which means that the mutually parallel defining surfaces of the linear slot-like opening formed between the jaws will be held parallel when the jaws 23 are subsequently swung synchronously towards each other so as to meet along the illustrated centre line 25.

Figure 6:
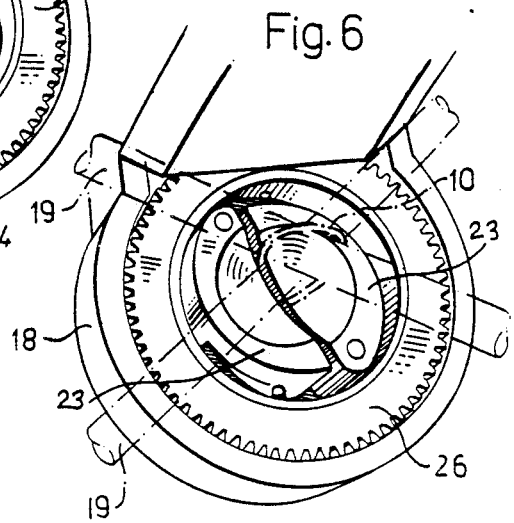
FIG. 6 illustrates the lashing head of FIG. 5 with the two gripping jaws incorporated in the head in a given position of rotation.

FIG. 6 is a view of the lashing or twisting head 18 subsequent to the jaws having been swung into gripping engagement with a wire tie 10, illustrated purely schematically, and upon commencement of their rotational movement for twisting the limbs of the tie together.

The jaws 23 have on their upper surfaces semi-circular, cup-shaped grooves which form effective guide surfaces for steering the limbs of respective ties into the slot-like opening between the jaws 23, should the limbs be presented obliquely to the opening.

Figure 7:
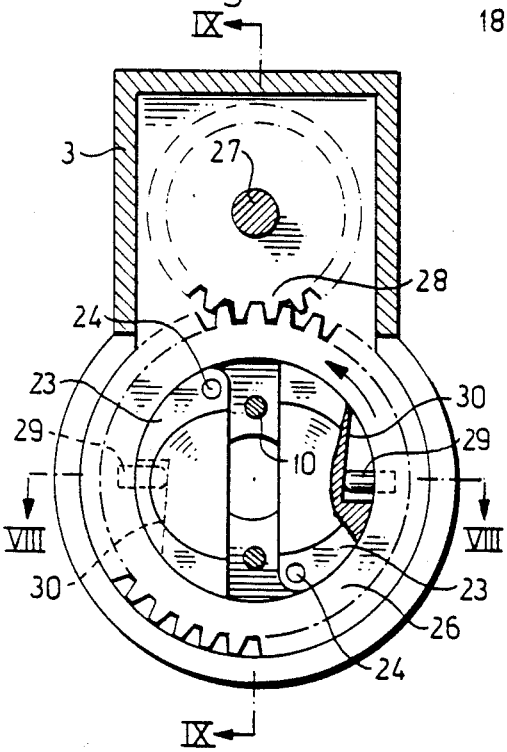
FIG. 7 illustrates the manner in which the gripping jaws are manipulated.

As illustrated in FIG. 7, the pivotal or swinging movement and the subsequent rotational movement of the jaws 23 are effected with the aid of a toothed ring, or spur ring 26 which encircles the jaws and which is driven by a pinion 28 mounted on a shaft 27 connected to the motor in the housing 3. The toothed ring 26 is provided on its inner peripheral surface with two camming or dogging pins 29, see also FIG. 8, which co-act with camming or dogging recesses 30 provided on the underside of respective jaws 23. Thus, when the toothed ring 26 is turned in the direction of the arrow shown in FIG. 7, the jaws 23 will first be swung by the pins 29 towards one another, so as to clamp the limbs of a wire tie 10, and then, upon further rotation of the toothed ring, will be dogged rotationally in a manner to twist the limbs of the tie one around the other.

Figure 9:
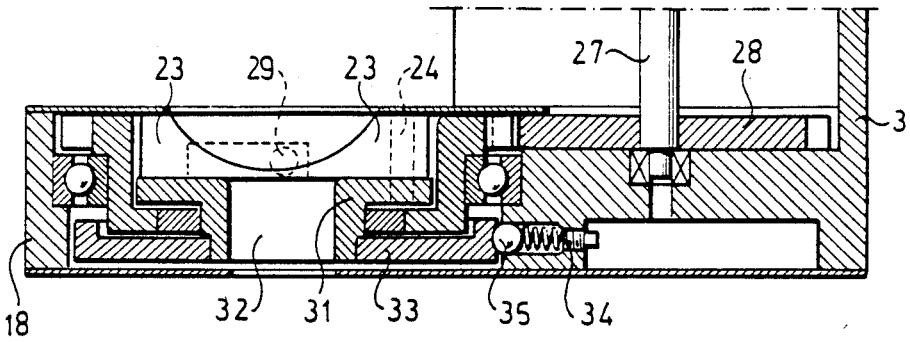
FIG. 9 is a sectional view taken on the line IX—IX in FIG. 7.
Figure 8:
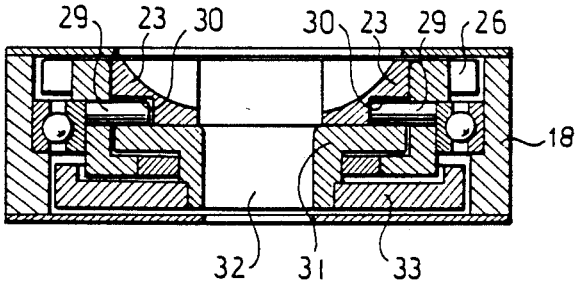
FIG. 8 is a sectional view taken on the line VIII—VIII in FIG. 7.

As illustrated in FIGS. 8 and 9, the jaws 23 are mounted, to this end, on a holder device 31 which includes a hub portion with a central aperture 32 for receiving the limbs of a tie, and a lower latching plate 33. Thus, the arrangement is such that subsequent to the jaws 23 being swung into gripping engagement with the limbs of a tie 10 by the camming action of the pins 29 as the toothed wheel 26 rotates, the holder 31 is dogged by the jaws as they start to rotate about the common centre axis. This rotation takes place subsequent to the force exerted by the pins 29 on the jaws 23 having first overcome the latching force that a spring-loaded ball 35, biassed by spring 34, exerts on the latching plate 33, said ball 35 engaging in a groove provided on the plate 33 to this end, see FIG. 9.

Subsequent to applying a tie and twisting the limbs thereof together, the toothed wheel is rotated in the reverse direction, by means of the motor, so as to swing the jaws outwards and therewith release the tie, whereupon the machine is ready for a further lashing operation, subsequent to the holder 31 having rotated through one revolution so that the ball 35 again snaps into the groove in and latches the plate 33. This reversal in the direction of rotation of the toothed wheel is preferably effected automatically after approximately three turns of the wheel in the lashing direction.

The described lashing machine enables reinforcement rods, bars and similar elongated members to be securely lashed together in a highly rational manner with no unnecessary stress and strain on the workman concerned. The machine also enables ties of varying wire thicknesses and limb spacings to be used, which is highly advantageous and even essential in view of the fact that the cross-sectional dimensions of reinforcement rods are liable to vary considerably, depending on the type of concrete structure under construction.

Although the inventive lashing machine has been described in the aforegoing with reference to a preferred embodiment thereof, it will be understood that various modifications can be made within the scope of the following claims. For example, the drive, latching and design of the jaws may be different to those described. For example, the dogging pins may extend vertically instead of horizontally. Furthermore, the pivotal movement and rotational movement of the jaws may be initiated automatically as a wire tie is dispensed from the dispenser 7. The dispensing of ties may also be made automatic. The FIG. 1 embodiment has been chosen in order to illustrate the manner in which the machine operates. The illustrated machine may be made neater and easier to handle, by encapsulating the moveable parts thereof. The machine can be made easier to handle, by lengthening the shaft 2 and fitting to the end thereof an underarm support, in the manner of a crutch. It will also be understood that the machine may be operated by power sources other than an electric motor.

I claim:

1. A lashing machine for lashing together mutually crossing elongated members with the aid of U-shaped wire ties, and particularly for lashing together reinforcement rods, said apparatus comprising a magazine (9) for ties (10); means (12) for dispensing ties singly from the magazine in a manner such that respective ties can be caused to engage over two mutually crossing elongated members at their mutual point of intersection; and a head (18) for receiving, holding and twisting together the limbs of respective U-shaped ties (10), characterized in that the head (18) comprises two mutually opposing pivotable jaws (23) which define therebetween a slot-like opening for receiving the limbs of respective ties (10) and which can be swung in a swinging movement relative to one another in a manner to reduce the width of the slot-like opening so as to grip the limbs of the tie therebetween; means for retaining said jaws stationary during said swinging movement of said jaws; and means for rotating the jaws about a common axis in the closed position of said jaws, in a manner to twist together the limbs of the tie held between said jaws.

2. A machine according to claim 1, characterized in that the jaws (23) are pivotably mounted on respective pivot pins (24) at mutually opposite ends of respective jaws (23) such that the defining surfaces of the slot-like opening are held substantially mutually parallel with one another when the jaws are swung synchronously towards one another.

3. A machine according to claim 1, characterized in that the jaws (23) are encircled by a rotatable element (26) provided with said means (29) for co-acting with the jaws in a manner to swing the jaws relative to one another and which means, upon completion of said swinging movement, is arranged to cause the jaws (23) to accompany the continued rotary movement of the rotatable element (26) about its axis of rotation.

4. A machine according to claim 3, characterized in that the jaws (23) are pivotally mounted on a common, rotatable holder (31) which is intended to be rotated by the jaws subsequent to completion of their swinging or pivotal movement.

5. A machine according to claim 4, characterized in that the rotatable holder (31) is intended to be dogged for rotation by the jaws (23) subsequent to overcoming a latching spring force (34).

6. A machine according to any claim 3, characterized in that the jaws (23) are arranged to be opened and to effect a return pivotal movement upon reversal of the rotational direction of the rotating element (31).

7. A machine according to any of claim 1, characterized in that the jaws (23) have provided thereon semicircular, cup-shaped recesses which form guide surfaces for the limbs of respective ties (10).

8. A machine according to any of claim 1, characterized in that the magazine (9) is mounted on a holder device or dispenser (7) arranged for movement towards and away from the head (18), and in that the dispenser (7) has arranged therein for movement relative thereto a tie dispensing member (12).

9. A machine according to claim 8, characterized in that the dispenser (7) includes a press plate having provided thereon mutually perpendicular guide grooves (21) for guiding and pressing the elongated members (19) towards and against the lashing or twisting head (18) as a tie (10) is dispensed.

10. A machine according to claim 9, characterized in that the dispensing means has the form of a plate (12) which is guided by the dispenser (7) into co-action with the leading or formemost tie (10) in the magazine (9).

11. The machine of claim 1 wherein said means for retaining comprising:

spring force biased locking means said spring force being overcome when the swinging movement of the jaws is completed to cause said jaws to rotate about said common axis.

12. A lashing machine for lashing together mutually crossing elongated members with the aid of wire ties having limbs that define a U-shape, and particularly for lashing together reinforcement rods, said machine comprising:

a magazine for ties, means for dispensing said ties singly from the magazine in a manner such that respective ones of said ties can be caused to engage over two mutually crossing elongated members at their mutual point of intersection.

a head for receiving, holding and twisting together the limbs of respective U-shaped ties, said head comprising two mutually opposing jaws which define therebetween a slot-like opening for receiving the limbs of said respective ties, and which jaws are pivotally mounted on a common, rotatable holder so that they can be swung relative to one another in a plane substantially perpendicular to the limbs of respective ties to reduce the width of the slot-like opening so as to grip the limbs of the tie therebetween, means for retaining said rotatable holder stationary under the influence of a latching spring force when the limbs of a wire tie are inserted between the jaws, and a rotable element which encircles the jaws and is provided with two means each cooperating with a respective jaw such that when rotating said element the jaws are first swung relative each other for gripping the limbs of the wire tie therebetween and then upon completion of the swinging movement and overcoming the latching spring force acting on the rotatable holder means the jaws are dogged in the movement of the rotating element for twisting together the limbs of the tie held between said jaws.

* * * * *